United States Patent [19]

Fischer

[11] 4,409,894

[45] Oct. 18, 1983

[54] ROTARY OFFSET SHEET SELECTIVE PRIME, VERSO OR MULTICOLOR PRINTING MACHINE AND METHOD

[75] Inventor: Hermann Fischer, Augsburg, Fed. Rep. of Germany

[73] Assignee: M.A.N.-Roland Druckmaschinen Aktiengesellschaft, Augsburg, Fed. Rep. of Germany

[21] Appl. No.: 353,229

[22] Filed: Mar. 1, 1982

[30] Foreign Application Priority Data

Mar. 7, 1981 [DE] Fed. Rep. of Germany ..... 8108806

[51] Int. Cl.[3] ..... B41M 1/14; B41F 5/16

[52] U.S. Cl. ..... 101/211; 101/230; 101/231; 101/184; 271/108

[58] Field of Search ..... 101/178, 211, 182–184, 101/230–232; 271/107, 108

[56] References Cited

U.S. PATENT DOCUMENTS

| | | | |
|---|---|---|---|
| 2,940,387 | 6/1960 | Pritchard | 101/183 |
| 3,785,287 | 1/1974 | Dahlgren | 101/184 |
| 3,800,698 | 4/1974 | Kist et al. | 101/184 |
| 3,884,146 | 5/1975 | Ruetschle | 101/183 |
| 3,946,669 | 3/1976 | Johne et al. | 101/183 |
| 4,081,945 | 4/1978 | Calvert et al. | 271/108 |
| 4,090,702 | 5/1978 | Wirz | 271/108 |
| 4,164,234 | 8/1979 | Liepert | 271/108 X |
| 4,218,272 | 8/1980 | Fujishiro | 101/184 |
| 4,327,906 | 5/1982 | Frohlich | 271/108 X |
| 4,369,705 | 1/1983 | Gelinas | 101/187 X |

*Primary Examiner*—E. H. Eickholt

*Attorney, Agent, or Firm*—Frishauf, Holtz, Goodman & Woodward

[57] ABSTRACT

To permit, selectively, multi-color prime printing or prime and verso printing on printing machines having plate blanket, and printing cylinders of the same diameter, the printing cylinders (8,9;51,52,53;77) have a rubber blanket thereon to receive printing information from the blanket cylinders (6,7;48,49,50;75,76) during one phase of operation and transferring this information to the sheet by engagement with the sheet supply or transport cylinders (12,60,78) which are formed with surfaces permitting them to operate as impression or printing cylinders, sheet supply being arranged to provide sheets in this mode of operation for every two revolutions of the cylinders only, to permit information transfer during the intervening idle, or non-printing phase or revolution. To prevent smearing, or transfer of unwanted ink, the blanket cylinders are supported in bearings which can rock about the center of rotation of the associated plate cylinders, under control of a control unit (C) to be placed in, or out of engagement with the printing or impression cylinders, in dependence on desired operation - multi-color prime printing or prime-and-verso printing under control of the control unit (C).

14 Claims, 10 Drawing Figures

ROTARY OFFSET SHEET SELECTIVE PRIME, VERSO OR MULTICOLOR PRINTING MACHINE AND METHOD

Cross reference to related applications, assigned to the assignee of this application, the disclosure of which is hereby incorporated by reference:

U.S. Ser. No. 353,235, filed Mar. 1, 1982, FISCHER (claiming priority Fed. Rep. Germany P No. 31 08 807.4; U.S. Ser. No. 353,230, filed Mar. 1, 1982, FISCHER (claiming priority Fed. Rep. Germany P No. 31088088.2;

The present invention relates to a rotary offset printing machine system in which subject matter can be printed, selectively, with various colors on one side of a sheet of paper, that is, in prime printing, or the paper can be printed on both sides, that is, printed can be effected both in prime and verso printing, and especially to such a machine which can readily be changed over between various required operating modes in accordance with specific printing jobs.

Printing machines to which the present invention generally relates are known and described, for example, in the book: Walenski "Einführung in den Offsetdruck," pages 147, 151, 154 and 155 ("Introduction to Offset Printing"). Printing machines there described have a reversing apparatus positioned between individual printing stations. The reversing apparatus is so constructed that grippers located on a drum, or cylinder, grip a sheet. The free end of the sheet is carried along suction devices, or grippers of an adjacent drum, to be gripped by the grippers or suction devices of the adjacent drum and, upon opening of the leading grippers of the first drum, the former trailing end becomes the leading end of the sheet for application to the next adjacent printing station. Arranging such a printing machine to carry out both prime and verso printing is more time consuming than setting up such a machine for single-sided printing only. In order to pevent production of scrap, compressed air jets and the like must be used, or other corrective measures taken so that the sheets are properly turned and handled, since, upon reversal of the sheet, the freshly printed ink tends to smear. In addition, the space factor of printing on the sheets is unsatisfactory because each sheet must have a strip along the leading edge, as well as along the trailing edge, free from printing, in order to permit the grippers to hold or clamp the sheet at the selected leading, or trailing end, in dependence on sheet orientation. The format of the sheet, thus, is poorly utilized when prime and verso printing is carried out in comparison to sheet utilization on only one side thereof, on which multiple color printing can be effected.

Printing machines capable of carrying out printing on both sides of the sheet are described on page 155 of the previously mentioned reference in which the sheet is printed on both sides as it passes between two rubber, or blanket, cylinders. Basically, such a machine can be used to print only on one side, with single color printing. This requires, however, that then a portion of the printing station, including its inking and damping system is disconnected. If the proportion of printing jobs requiring prime and verso printing is low in relationship to the jobs requiring only prime printing, a machine of this type is poorly utilized during a large portion of its operating time.

THE INVENTION

It is an object to provide a printing machine which is so arranged that it can either print multicolor prime printing or prime and verso printing, and which can be easily changed over to print in the two selected modes of printing, and which utilizes the format of the substrate web, typically paper, as efficiently and as completely as possible. Preferably, further, the machine should be readily compatible with existing machines and the arrangements should be such that existing machines can be retrofitted to obtain the benefits of the present invention.

Briefly, the printing machine has rubber blanket cylinders, plate cylinders, printing or impression cylinders and at least one sheet supply cylinder, all of the cylinders being of the same diameter. A selection means is provided to control the relative position of at least one of the rubber blanket cylinders with respect to the impression cylinder, and the position of the impression cylinder with respect to the supply cylinder to provide for engagement, that is, transfer of printed subject matter, or disengagement. The impression cylinder has a rubber blanket so that it, also, can receive printed subject matter and, in one printing mode, cooperate with a supply cylinder to transfer printed subject matter to the substrate, typically a web of paper.

The machine has the advantage that the change-over between prime and verso printing, or multi-color prime printing can readily be controlled and effected, and that the change-over system can be incorporated in existing printing machines, since the basic structure of existing printing machines is retained.

DRAWINGS

Figure 1:
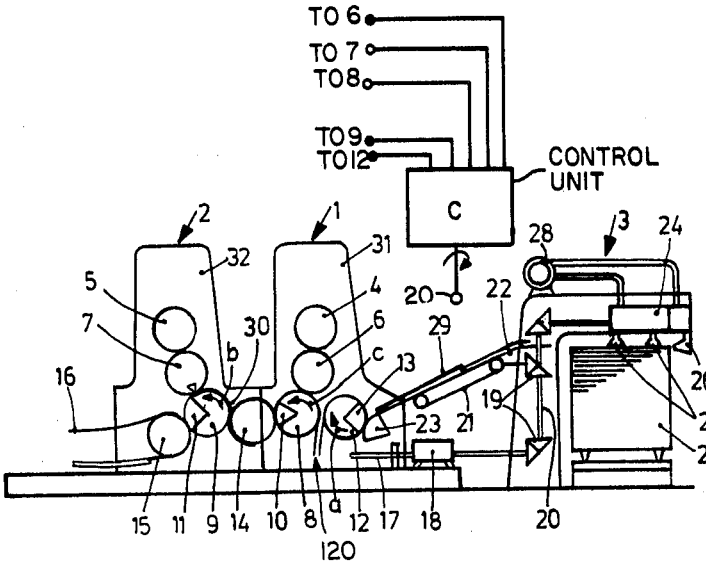
FIG. 1 is a schematic side view of a printing machine system illustrating the basic arrangement, and operation in the first working phase.

The substrate on which printing is to be effected can be of any type, but since usually and typically it is paper, it will be referred to hereinafter as "paper." Printing lines, or printing contact is schematically indicated in the drawings by a small triangle pointing towards the circumference of the respective cylinder transferring printed information to the paper; and grooves or gripper arrangements are illustrated by an open V towards the circumference of a cylinder, schematically showing a gripper groove and gripper structure, which may be of any well-known and suitable construction, and already form part of an existing offset sheet fed printing machine.

EMBODIMENT OF FIGS. 1-4

A two-color sheet offset rotary printing machine is constructed in serial arrangement. Two printing stations 1,2 work together with a sheet supply apparatus 3, to form a printing machine system. Each of the printing stations 1,2, have a plate cylinder 4,5, a rubber blanket cylinder 6,7 and a printing or impression cylinder 8,9. Inking systems and damping systems, customary in offset printing machines are provided, and not shown in the drawings, for simplicity. In contrast to customary construction, the printing or impression cylinder 8 has a rubber blanket thereon to which subject matter for printing can be transferred. The printing cylinders 8,9 have grooves 10,11 illustrated by V-shaped lines extending towards circumference thereof, with sheet grippers located therein. In addition, a supply drum 12 is provided in printing station 1 which can also form a printing or impression cylinder, the supply drum or cylinder having a groove 13. A transport drum 14 is located between the stations 1,2. Supply drum 14 carries grippers, not shown, or further indicated. The printed goods are removed by a chain conveyor 16 having gripper thereon, passing about sprocket wheels 15, to transport sheets to a sheet delivery station, not shown.

Figure 2:
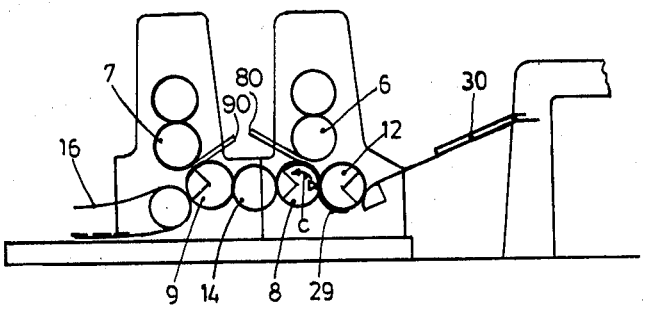
FIGS. 2, 3 and 4 are fragmentary side views of the structure of FIG. 1, at different time instances of the operating cycle of the machine.

The rubber cylinders 6,7 are journalled in the sidewalls 31, 32 of the printing stations 1,2 in such a manner that the relative position of the rubber blanket cylinders can be changed. FIGS. 1 and 2, respectively, show different positions of the blanket cylinder 6,7. In either position, surface contact with the respective associated plate cylinder 4,5 is maintained. Change of position of the rubber blanket cylinders can readily be effected as well-known by placing the bearings for the rubber blanket cylinders in an eccentric bushing, or positioning the bearings on a pivoting lever. The respectively controlled position can be changed, and then secured by means of fluid piston-cylinder arrangements, for example hydraulic pistons. Electrical or mechanical control apparatus is then coupled to the fluid positioning device in order to apply pressure fluid to the piston of the positioning element and thus effect positioning movement thereof, as commanded, at a required instant of time. Positioning arrangements of this type are known and were used, in the past, to effect positioning of the rubber blanket cylinder on the impression cylinder, upon introduction of the first sheet of a sheet-fed printing machine in dependence on supply of the sheet to the respective printing, or impression line.

In accordance with the present invention, the control system is so modified, or expanded, that, in addition, for example, to the known control, the functions which will be described in detail below, likewise can be carried out. The printing supply cylinder, forming an impression cylinder 12, likewise should be capable of movement between the two positions shown, respectively, in FIGS. 1 and 2.

The sheet supply apparatus 3 is driven from a main drive shaft 17 of the printing machine, shown only schematically in fragmentary form, through a two-step gear change box 18, and over bevel gears 19 forming a main power drive train 20. The power drive train 20 also drives transport or conveyor belts 21 which transport the sheet to a make-ready table 22 and then to a gripper set 23. The drive train 20 additionally is connected to a sheet lifting apparatus 24 having movable suction grippers 25 and compressed air nozzles 26, lifting off the upper sheet from a stack of sheets 27 for supply to the make-ready table 22. The sheet lifting device 24 includes not only the mechanical means to operate the suction grippers 25, but, additionally, control elements which supply the suction grippers 25 and the air nozzles 26 with suction or compressed air, respectively, derived from a pump 28. The gear change box 18 permits, selectively, change of the transmission ratio of drive power from shaft 17 to drive train 20 with a transmission ratio of either 1:1 or 2:1.

FIGS. 1 to 4 illustrate the operation of the printing for prime and verso printing. In this adjustment, the printing station 1 provides the verso printing, and the printing station 2, the prime printing.

FIG. 1 illustrates the machine at the instant of time in which the grippers 23 grip a sheet 29. The supply impression cylinder 12 is spaced from the printing cylinder 8. Printing cylinder 8 is covered with a rubber blanket. The rubber-covered printing cylinder 8 is in engagement with the rubber blanket cylinder 6. The separation between the printing or impression cylinder 8, and the supply or printing cylinder 12 is schematically indicated by the gap lines 120. Engagement of the rubber blanket cylinder 6 with the rubber blanket of the impression and printing cylinder 8 transfers the subject matter to be printed from the blanket cylinder 6 to the impression cylinder 8. FIG. 1 further shows that a sheet 30 just is being introduced into the printing station 2, which receives prime printing between the blanket cylinder 7 and the impression cylinder 9, which are in surface contact with each other.

The printing or impression cylinder 12 rotates in the direction of the arrow a and, starting from the position shown in FIG. 1, after a short rotary movement, the sheet 29 will be transferred thereto from the grippers 23. As soon as the sheet 29 approaches the gap 120 to the blanket-covered impression cylinder 8, the printing or impression cylinder 12 is engaged with the impression cylinder 8, thus eliminating the gap 120. The sheet 29 is then transferred to the grippers of the blanket-covered impression cylinder 8. The following sheet passage phase, then, will effect verso printing on the sheet 29. As the cylinder 8 rotates, its groove 10 will approach the blanket cylinder 6. The blanket cylinder 6 is, thereupon, lifted off from contact with the blanket-covered impression cylinder 8 for the duration of the sheet passage phase, so that the sheet 29 runs free and out of contact with respect to the blanket cylinder 6. The gap between cylinders 6 and 8 is schematically indicated in FIG. 2 by gap lines 80. The cylinders will rotate for 360°, starting from the position shown in FIG. 1 and then will have the relative, or respective positions shown in FIG. 2. Verso printing on the sheet 29 is indicated by the small triangle tracing the outside circumference in FIG. 2.

Figure 3:
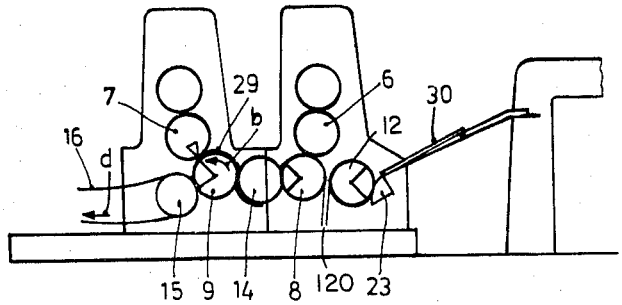
Figure 4:
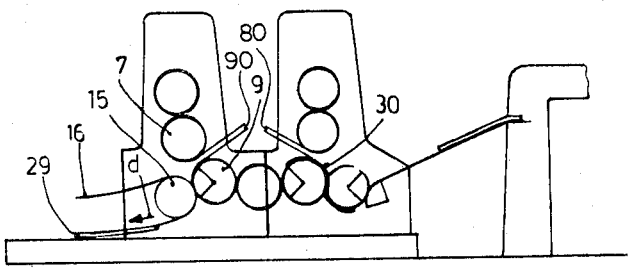

Upon further rotation of the cylinders, sheet 29 is transferred to the transport drum 14 which continuously rotates with slight distance from the printing cylinders 8,9. The slight distance prevents soiling of the surface of the transport drum 14 by ink being transferred from the blanket-covered printing cylinder 8. As soon as the trailing end of the sheet 29 leaves the gap between the printing or impression cylinder 8 and the printing or impression cylinder 12, printing or impression cylinder 12 is shifted in position back to that of FIG. 1, and as also illustrated in FIG. 3. The cylinder 12 remains in this position during the subsequent freewheeling or idling phase. When the end of the sheet 29 passes through the gap between the blanket-covered printing cylinder 8 and the blanket cylinder 6, blanket cylinder 6 is again engaged with the blanket-covered impression cylinder 8, so that the impression cylinder 8 can be inked from the blanket cylinder 6 during the free-wheeling or idling, or non-printing phase. These phases, as can be seen, take up the time of about one revolution of the respective cylinder. As soon as the leading edge of the sheet 29 reaches the grippers of the printing or impression cylinder 9, as seen in FIG. 3, and upon transfer from the grippers of the transport drum 14, the sheet will reach the gap between the printing cylinder 9 and the blanket cylinder 7, and, at that time, the two cylinders are engaged with each other. Prime printing then is effected. After rotation of the cylinders about 720°, the sheet 30 following the sheet 29 is picked up by the grippers 23, as illustrated in FIG. 3.

The foregoing sequence of operation illustrated prime and verso printing. The number of sheets, with respect to the revolution of the cylinders, is half that of single-sided multi-color printing. Supply of only half the number of sheets, per revolution of the printing stations, is obtained by the gear box 18, which will be set to the transmission ratio 2:1. With respect to the revolutions of the cylinders of the printing machine, in comparison to single-sided multi-color printing, only half the number of sheets will be supplied to the grippers 23.

Upon further rotation of the printing cylinder 9 in the direction of the arrow b, see FIG. 3, the printing cylinder 9 will transport the sheet so that its leading edge will reach grippers (not shown) on the chain 16 looped about the sprocket wheels 15. The grippers on the chain will grip the sheet for transport outwardly of the printing system in the direction of the arrow d to a discharge or delivery point or station. Upon transport of the sheet outwardly of the printing system and as soon as the trailing end of the sheet 29 has left the printing or impression line between the blanket cylinder 7 and the printing or impression cylinder 9, the cylinders are separated from each other, as schematically illustrated by the separating line 90, FIGS. 2,4, so that the rubber blanket on the blanket cylinder 7 does not transfer ink to the impression cylinder 9 during the subsequent non-printing or idling phase of operation, that is, of rotation of the cylinders, during which no sheet passes at this point through the machine. This prevents soiling of a subsequent sheet at the reverse side thereof.

For single-sided multi-color printing, the machine is used in standard manner, as well known, and a detailed description thereof is not necessary. The sheets are transported between the impression cylinder 6 and the blanket-covered printing cylinder 8, around the transport drum 14 and again between the second blanket cylinder 7 and the second impression cylinder 9, as well known.

Rather than supplying the impression cylinder 8 with a rubber blanket to effect verso printing, the impression cylinder 9 can have a rubber blanket applied thereto. In that case, the transport drum 14 also should be constructed as an impression or printing cylinder, and its position controlled as described above with respect to the impression or printing cylinder 12.

Additional printing stations can be added behind the printing station 2, which, respectively, can carry out prime, or verso printing, as required.

A control unit C is provided which has output lines controlling the position of the respective cylinders 6,7,12, as required. The control unit C receives a synchronizing input from the drive train 20, as schematically indicated, and provides the output control information, in time, to the respective positioning elements (not shown) which move the centers of rotation of the cylinders in accordance with the above-described operating sequence.

EMBODIMENT OF FIGS. 5 AND 6

A serially constructed three-color sheet offset rotary printing machine is there shown, formed of three printing stations 41,42,43. The control unit C has been omitted from FIGS. 5 and 6, as well as from FIGS. 7 to 10, for simplicity of illustration. Its function will be described below. A sheet supply device 44 is provided which can be similar to that described in connection with FIG. 1. Each one of the printing stations have plate cylinders 45,46,47, a rubber blanket cylinder 48,49,50 and a printing or impression cylinder 51,52,53. The inkers and dampers associated with the plate cylinders 45,46,47 have been omitted from the drawing for clarity, and can be in accordance with any well-known and standard construction. A make-ready table 54 provides sheets from the sheet-feeding apparatus 44 to the first printing station 41. It includes a gripper arrangement 55 which transfers the sheets to the grippers of a supply drum 56. The grippers thereof cooperate with the grippers of the printing or impression cylinder 51. A transport drum 57 transfers the sheets between the first and second printing stations 41,42 and to further transport drums 58,59 transport the sheets to a further transport drum 60 which is formed as an impression or printing cylinder. The printing cylinder 60 can cooperate with the impression or printing cyinder 53 to generate printing in the reverse side, that is, a verso print. The printing or impression cylinder 53 carries a rubber blanket. A delivery chain 62 is provided, supplied with grippers (not shown) and guided about sprocket wheels 61 in order to transport the sheets to a delivery station (not shown).

OPERATION, FOR PRIME AND VERSO PRINTING

Figure 5:
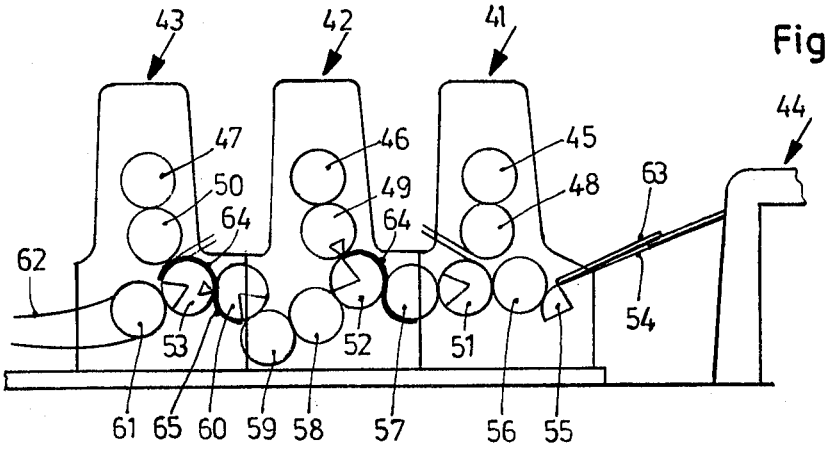
FIG. 5 is a schematic side view of an other machine, illustrating a different printing system arrangement.

The printing stations 41,42 are arranged to each provide prime printing, and printing station 43 provides for verso printing. FIG. 5 illustrates the position of the elements of the printing stations at the instant of time in which a sheet 63 has been gripped by the grippers 55. The printing station 41 is in the condition in which the blanket cylinder 48 is separated from the impression cylinder 51, so that the surface of the impression cylinder 51 cannot cause smearing, or soiling of ink on the blanket cylinder 48. As soon as the sheet 63 enters the gap between the cylinders 48,51, the blanket cylinder 48 is placed in engagement with the printing cylinder 51. It is moved in a circular, or arcuate path about the plate cylinder 45. The first printing station 41 thus will place a first prime printing on the sheet 53.

Figure 6:
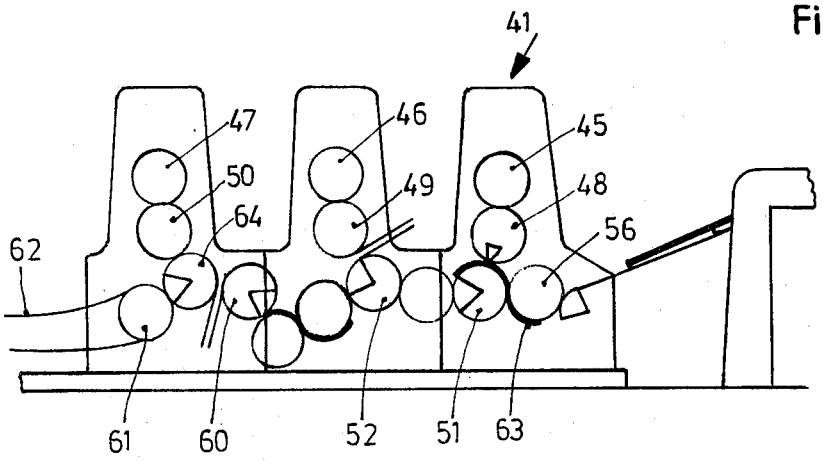
FIG. 6 is a side view of the machine of FIG. 5 at another instant during the operating cycle of the machine.

FIG. 6 illustrates the position of the cylinders after rotation thereof about 360° with respect to FIG. 5.

As soon as the sheet 63 has reached the grippers 55, a preceding sheet 64 is in position to enter the gap between the impression cylinder 52 and the blanket cylinder 49. This printing causes the second prime printing to be effected. The third printing station 43, at the same instant of time, provides for verso printing by the impression cylinder 53 which, as stated, is formed with a rubber blanket, and the printing cylinder 60, applying the verso print to a sheet 65.

As soon as the trailing end of the sheet 63 has left a printing line between cylinders 48,51, blanket cylinder 48 is moved about the axis of rotation of plate cylinder 45 and thus separated from the impression cylinder 51 for the duration of the subsequent non-printing or idling phase. Sheet 63 is guided over the transport drum 57 to the impression cylinder 52. As soon as the leading edge of the sheet 63 reaches the printing line between the blanket cylinder 49 and the printing cylinder 52, blanket cylinder 49 is engaged with the printing cylinder 52. Blanket cylinder 49 previously, and for the duration of the idling or non-printing phase, has been separated from the impression cylinder 52 to prevent smearing or soiling thereof. The second prime printing then is effected on the sheet 63. The sheet 63 is then transported via the transport drums 58,59 to the impression cylinder 60.

As soon as the leading edge of the sheet 63 reaches the gap between the impression cylinders 53 and 60, the cylinders are engaged with each other. The sheet will receive the verso print from the rubber blanket of the impression cylinder 53. When the leading edge of the sheet approaches the blanket cylinder 50, it is separated from the impression cylinder 53 so that the sheet 63 can freely move between the cylinders 50 and 53. As soon as the trailing end of the sheet 63 has passed gap between the cylinders 50 and 53, the blanket cylinder 50 is swung about the axis of rotation of the plate cylinder 47 so that it is engaged with the surface of the impression cylinder 53, to transfer printed information thereto. During the course of the subsequent idling or non-printing phase, in which no sheet is located between the two cylinders 50,53, the rubber blanket on the impression cylinder 53 accepts the printing image for verso printing which, then, is subsequently applied to the next following sheet. When the leading edge of the sheet 63 reaches the conveyor chain 62, the grippers thereon will grip the sheet and transport it to the delivery station.

Operation of the machine with the prime three-color printing is well known and need not be described in detail.

The printing system illustrated in FIGS. 5 and 6 preferably applies verso printing in the last printing station 43 since three transport drums are positioned between this printing station and the adjacent printing station 42 and which facilitate the required engagement and separating movement of the transport drum 60, which is formed as an impression, or printing cylinder.

As can be seen, the system shown in FIGS. 5 and 6 can readily be expanded by further printing stations which can apply only prime printing or verso printing, or can be constructed to be, selectively operable as prime and verso printing stations.

EMBODIMENT OF FIGS. 7 TO 10

Figure 7:
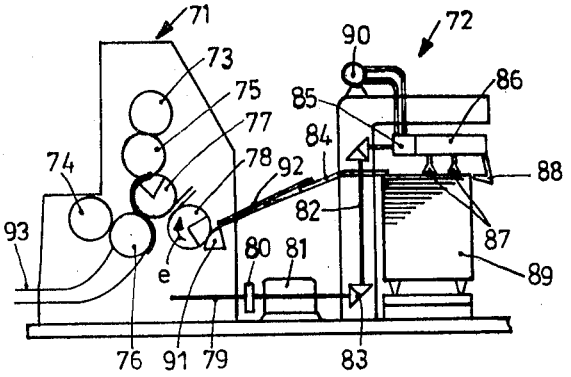
FIG. 7 is a fragmentary side view of another type of printing machine, constructed in accordance with the present invention.

FIG. 7 illustrates a rotary offset sheet-fed printing machine having a double-printing station 71 and a sheet supply device 72. The double-printing station 71 has two plate cylinders 73,47, two blanket cylinders 75,76 and one impression or printing cylinder 77. Additionally, a supply drum 78 is provided which simultaneously has the function of a printing cylinder 78 and which can be shifted in position, as will be described. The printing cylinder 77 has a rubber blanket applied thereto suitable for transmission of printed subject matter. The printing cylinders 75,76 are located to be movable, in the sidewalls of the machine, that is, are positioned in eccentrically shiftable bearings, on pivot levers, or the like, for switching between positions to be described. A sprocket wheel is located at the two ends of the blanket cylinder 76, guiding a sheet removal and transport chain 93, supplied with grippers (not shown) to remove printed sheets to a delivery station. The inkers and dampers associated with the plate cylinders 73,74 have been omitted for clarity of illustration and can be in accordance with any well-known and standard construction.

A main power drive shaft 79 is provided to drive the printing machine as well as the sheet delivery apparatus 72. The shaft 79 is driven over a belt drive 80 from an electric motor 81. A drive train 82 is provided, coupled to shaft 89 by bevel gears 83. The drive train 82 is branched to drive the transport belts of the make-ready table 84, similar to the arrangement of FIG. 1, for example, and additionally is connected to a control unit 85 and the sheet-lifting apparatus 86 having suction grippers 87 and air nozzles 88. The suction-lifting device 86 so moves the suction grippers 87 that they pick up the uppermost sheet from a stack of sheets 89 for supply to the make-ready table 84. The suction and compressed lines from a pump 90 terminate in the control device 85 which controls supply of suction, as well as of blowing air to the suction grippers 87 and the nozzles 88, respectively, in such a manner that upon setting of the printing machine for single-sided two-color printing, the suction grippers pick up a sheet upon each reciprocating movement thereof, by being connected to the suction source, and supply a sheet to the make-ready table upon each movement. Upon adjustment of the system, however, for prime and verso printing, the suction and blowing air control is so arranged by the control apparatus or control unit 85 that the suction grippers pick up a sheet only upon every second reciprocating movement thereof. Similarly, the air nozzles 88 are controlled, in intermittent recurring steps, so that they will have compressed air applied thereto only when the suction grippers 87 are connected to the vacuum source provided by pump 90. Thus, and with reference to the machine operating speed of revolution, only half the number of sheets are lifted off the stack 89 and supplied to the make-ready table when prime and verso printing is to be effected. Grippers 91 are provided to transfer a sheet from the make-ready table 84 to the printing or impression cylinders 78.

Let it be assumed that the printing cylinder 78 rotates in the direction of the arrow e; starting from the position shown in FIG. 1, and upon a short further rotation, the impression cylinder 78 will pick up a sheet from the grippers 91. As soon as the printing cylinder 78 has transported the sheet 92 into the gap to the impression cylinder 77, the printing cylinder 78 is engaged with the impression cylinder 77. The impression cylinder 77 is still in contact with the blanket cylinder 75 and thus accepts printed subject matter or information from the blanket cylinder 75. Thereafter, the sheet 92 is transferred to the grippers of the impression cylinder 77. As the sheet passage phase continues, sheet 92 is printed on the reverse between the impression cylinder 78 and the impression or printing cylinder 77, since the impression cylinder 77, carrying a rubber blanket, has received information from blanket cylinder 75. Upon further rotation of the impression cylinder 77, the leading edge of the sheet 92 will reach the blanket cylinder 75 which, thereupon, is separated from the blanket cylinder 77 for the duration of the sheet passage, or idling phase, so that the sheet 92 can freely pass the blanket cylinder 75 without contact therewith. This separation is schematically indicated by the gap lines 175 in FIG. 8. Upon further rotation of the cylinders, sheet 92 is transferred to the gripper system of the chair 93, which has a precise orientation with respect to the blanket cylinder 76. Simultaneously, the blanket cylinder 76 is engaged with the impression cylinder 77, so that prime printing is effected as the sheet passes between the blanket cylinder 76 and the impression cylinder 77—see FIG. 9. As soon as the trailing end of the sheet leaves the gap between the blanket cylinder 75 and the impression cylinder 77, the blanket cylinder 75 is engaged with the impression cylinder 77. During this non-printing phase, the rubber blanket of the impression cylinder 77 accepts the printed information from the blanket cylinder 75, see FIG. 9.

Figure 8:
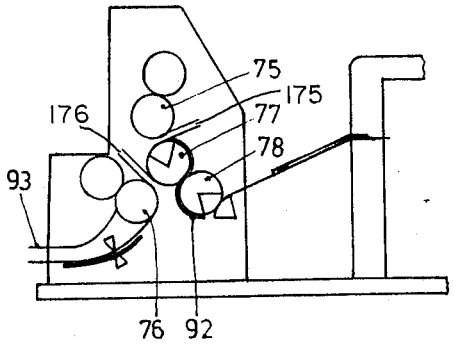
FIGS. 8 to 10 are schematic side views of the machine of FIG. 7 at different time instances during the operating cycle of the machine.
Figure 9:
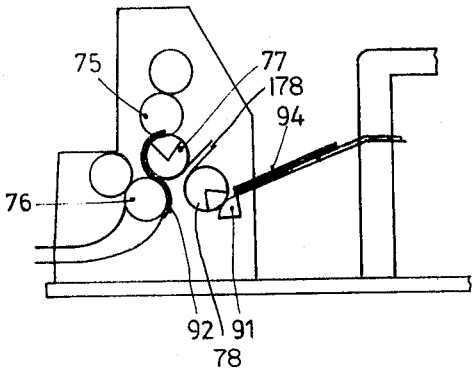
Figure 10:
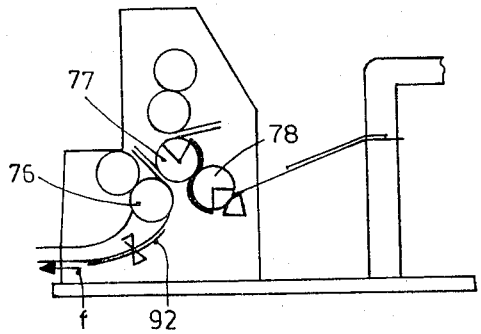

FIG. 8 illustrates the position of the cylinders after they have rotated 360° from the position shown in FIG. 7.

A further sheet 94 is being applied to the grippers 91 and is carried through the printing stations in the same manner as the sheet 92. Feeding only half the number of sheets, with respect to single-sided two-color printing, is obtained by so controlling the suction grippers 87 that they lift off a sheet only upon every other transport movement from the stack 89, since they are only then connected with the suction source by operation of the control unit 85. The movement of the suction grippers 87 after having supplied one sheet will be an idling movement, that is, no sheet is transferred to the machine from the stack since no suction air is being applied to the suction grippers 87.

Reverting again to the printing operation: as soon as the trailing end of the sheet 92 has left the printing line between the impression cylinder 77 and the blanket cylinder 76, blanket cylinder 76 is separated from the impression cylinder 77, as schematically indicated by the gap lines 176, FIG. 8, so that the rubber blanket on the blanket cylinder 76 does not supply ink to the impression cylinder 77 during the subsequent idling, or non-printing phase, during which no sheet passes this position of the printing machine. Thus, no ink can be transferred to the impression cylinder 77 which might lead to soiling or smearing of the verso print.

Chain 93 transports the sheet in the direction of the arrow f to a sheet delivery apparatus, not shown. The chain 93 may, of course, also transfer the sheet to a subsequently connected printing station.

Operation of the machine to carry out single-sided two-color printing is well known and a detailed discussion thereof is not needed.

The printing machines as described have the further possibility to provide for double-inking of the blanket cylinders upon multiple color printing. To do so, the sheet supply apparatus 3,44,72, respectively, is controlled for the position to supply a sheet only for every other printing operation or cycle, that is, in the position used for combined prime and verso printing. The printing and blanket cylinders are so controlled with respect to their relative positions, however, as described for the printing stations supplying the prime printing. For example: the machine in accordance with FIG. 1 has the blanket cylinder 6,7 so controlled that, as described in connection for prime and verso printing—the respective blanket cylinder 6,7 is in engagement with the respective impression cylinder, with a sheet therebetween. During the subsequent non-printing or idling phase, however, the blanket cylinders are separated from the impression cylinder. Since the cylinders, during two subsequent printing phases rotate by 720°, respectively, the blanket cylinder 6,7 will receive double inking for each sheet which is actually printed. The printing machines of FIGS. 5 and 7 can be similarly operated. Applying double the ink has the advantage that the printed result will have a particularly good color saturation.

Various changes and modifications may be made, and features described in connection with any one of the embodiments may be used with any of the others, within the scope of the inventive concept. For example, any suitable sheet supply apparatus may be used, and any one of the apparatus 3,44,72 may be used with any other one of the printing machine systems, as described. Further, for example, a control unit C can be used with the embodiment illustrated in FIG. 7, for example, to the pneumatic control unit 85 for engagement and separation of the respective cylinders in properly time synchronism with respect to the feeding movement of the sheet supply apparatus and in relation to the rotary positions of the respective cylinders. Such a control system may, for example, be electrical, or can be mechanical, for example cam-controlled in which a cam with suitable lands rotates in synchronism with the drive train 82 to control the position of the respective cylinders by mechanical or hydraulic positioning systems in accordance with the selected mode of operation of the machine.

I claim:

1. Method of selectively printing multi-color, or prime-and-verso printing in a rotary sheet of said printing machine having a sheet supply apparatus (3,44,72);

at least one sheet supply cylinder (12,60,78);

at least two rubber blanket cylinders (6,7;48,49,50;75,76) in continuous surface engagement with an associated respective plate cylinder;

at least one printing or impression cylinder (8,9;55,52,53;77), said printing or impression cylinder having a rubber blanket thereon, comprising, in accordance with the invention, controlling the respective engagement positions of at least one of the rubber blanket cylinders (6,50,75) and the associated printing or impression cylinder (8,52,77) in intermittent operation by (a) positioning the at least one rubber blanket cylinder, carrying verso printing information, and the associated printing or impression cylinder to be separated from each other during essentially one revolution of the respective cylinders, to form a first operating phase;

(a1) positioning the at least one rubber blanket cylinder and the associated printing cylinder in surface engagement with each other to effect transfer of printed subject matter and for verso printing during essentially a sequential revolution of the respective cylinder, and forming a second operating phase;

(b) positioning the printing or impression cylinder (8,52,77) and the sheet supply cylinder (12,60,78) during said first phase to effect verso printing and (b1) positioning said printing or impression cylinder and the sheet supply cylinder to be separated or surface-disengaged from each other during said second operating phase; and (c) positioning selected ones of the rubber blanket cylinders (7;48,49;76) and the associated printing or impression cylinders (9;51,52;77) during said first operating phase to effect prime printing and (d) then positioning said selected ones of the rubber blanket cylinders and the associated printing or impression cylinders during a second operating phase at surface-separated positions.

2. Method according to claim 1 wherein said positioning step comprises moving the respective rubber blanket cylinders (6,7;48,49,50) in an arcuate path about the associated plate cylinder (4,5;45,46,47) to maintain surface engagement between the rubber blanket and the associated plate cylinder between two positions, wherein, in one position, the blanket cylinder is in engagement with the associated printing or impression cylinder (8,9;51,52,53) and in another position, out of surface engagement with the respective printing or impression cylinder.

3. Method according to claim 1 wherein said moving step comprises selectively moving the position of the sheet supply cylinder (12,60,78) with respect to the centers of rotation of the rubber cylinders.

4. Method according to claim 1 further comprising the step of controlling operation of said sheet supply apparatus to supply a sheet, selectively, for each rotation of the cylinders about 360° or about 720°.

5. Method according to claim 1 including the step of supplying a sheet for every 720° of rotation of said cylinders;

and wherein the steps of controlling the positions of the cylinders comprise engaging the blanket cylinders (6,7;48,49,50;75,76) with the associated printing cylinders (8,9;51,52,53;77) during each first operating phase and then controlling said cylinders during the subsequent second or idling or non-printing phase to separated position with respect to each other.

6. Rotary offset sheet printing machine system having a sheet supply apparatus (3,44,72);

at least one sheet supply cylinder (12,60,78);

at least two plate cylinders (4,5; 45,46,47; 73,74);

at least two rubber blanket cylinders (6,7; 48,49,50; 75,76) in continuous surface engagement with an associated, respective plate cylinder;

at least one printing or impression cylinder (8,9; 51,52,53; 77), all said cylinders having the same diameter;

and comprising, in accordance with the invention means for selective printing in multi-color, or prime and verso printing including a rubber blanket on at least one printing or impression cylinder;

speed selection means (18,85) coupled to and selectively controlling the speed of sheet delivery of the sheet supply apparatus in two different speed ranges to supply sheets at the first predetermined rate for multi-color prime printing and to supply sheets at half said predetermined rate for prime and verso printing;

and position control means (C) connected to and controlling the relative engagement positions of the at least one rubber blanket cylinder (6,5,75) and the associated printing, or impression cylinder (8,52,77) in intermittent operation:

(a) for separating the at least one rubber blanket cylinder, carrying the verso printing information, and the associated printing or impression cylinder during essentially one revolution of the respective cylinders and during a first operating phase, and then engaging said at least one rubber blanket cylinder with the associated printing cylinder to effect transfer of printed subject matter for verso printing during essentially a sequential revolution of the respective cylinders and during a second operating phase;

(b) for engaging the printing or impression cylinder (8,52,77) with the sheet supply cylinder (12,60,78) during said first phase to effect verso printing, and for separating the printing or impression cylinder and the sheet supply cylinder during said second operating phase; and (c) for engaging selected ones of the rubber blanket cylinders (7;48,49;76) and the associated printing or impression cylinder (9;51,52;77) during the first operating phase to effect prime printing and separating said cylinders during the second operating phase.

7. System according to claim 6 wherein at least one of said sheet supply cylinders (12,78) has a surface forming an impression or printing cylinder for verso printing thereagainst by an impression or printing cylinder (8,77).

8. System according to claim 6 wherein the at least two rubber blanket cylinders and at least two plate cylinders form printing stations (1,2; 41,42,43) are provided;

and wherein a transport drum (60) is provided, to transport sheets between printing stations, said transport drum having a surface and position to form an impression, or printing cylinder for verso printing in one of said stations (2,43).

9. System according to claim 6 wherein (FIGS. 7–10) a single impression cylinder (77) is provided to form, with two rubber blanket cylinders and two plate cylinders, a five-cylinder printing system;

and wherein said impression cylinder (77) is provided with a rubber blanket and positioned for cooperation with one of said rubber blanket cylinders (75) to receive printed information for transfer to a side of the sheet being fed to the system.

10. System according to claim 6 wherein said position control means (C) move the respective blanket cylinders circumferentially about the axis of rotation of the associated plate cylinder to effect separation of the respective blanket cylinders (6,7;48,49,50) from the associated impression cylinders (8,9;51,52,53).

11. System according to claim 10 wherein said position control means further is effected to change the axial position of the sheet supply cylinder (12,60,78) when functioning, selectively, for sheet supply or as an impression or printing cylinder.

12. System according to claim 6 further comprising a main drive shaft (17) and a drive train (20) coupled to the main drive shaft and controlling and energizing operation of said sheet supply apparatus (3,44);

and a two-step gear box (18) interposed between the main drive shaft and the drive train for the sheet supply apparatus and having, selectively, a transmission ratio of 1:1 and 2:1.

13. System according to claim 6 wherein said sheet supply apparatus (72) is a reciprocating pneumatic supply device having pneumatic means to lift a sheet from a stack (89) of sheets;

and selectively operable control means (85) are provided controlling operation of the pneumatic lifting device, selectively, to pick up a sheet from the stack of sheets (89) upon each reciprocating movement or upon every other reciprocating movement.

14. System according to claim 6 wherein, upon the speed selection means controlling said sheet supply apparatus to operate at half said predetermined rate, the position control means (C) controls the position of the rubber blanket cylinders (6,7;48,49,50;75,76) and the associated printing cylinders (8,9;51,52,53;77) to be in engagement during said first operating phase and to be separated from each other in the subsequent second operating phase, forming a non-printing or idling phase of operation.

* * * * *